US006485297B2

(12) United States Patent
Nakamura

(10) Patent No.: US 6,485,297 B2
(45) Date of Patent: Nov. 26, 2002

(54) THERMAL TREATMENT FURNACE HAVING GAS LEAKAGE PREVENTING FUNCTION

(75) Inventor: Takashi Nakamura, Shiga (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/859,014

(22) Filed: May 15, 2001

(65) Prior Publication Data

US 2001/0044091 A1 Nov. 22, 2001

(30) Foreign Application Priority Data

May 22, 2000 (JP) ..... 2000-149330

(51) Int. Cl.[7] ..... F27B 5/16

(52) U.S. Cl. ..... 432/242; 432/200; 432/254.2; 392/416; 392/418

(58) Field of Search ..... 432/200, 209, 432/241, 242, 244, 247, 254.2, 262; 219/390; 392/416, 418

(56) References Cited

U.S. PATENT DOCUMENTS 4,989,540 A * 2/1991 Fuse et al. ..... 118/724
5,063,031 A * 11/1991 Sato ..... 118/725
5,252,062 A * 10/1993 Groves et al. ..... 432/205
6,075,922 A * 6/2000 Tay et al. ..... 392/416

* cited by examiner

*Primary Examiner*—Gregory A. Wilson
(74) *Attorney, Agent, or Firm*—Todd M. C. Li

(57) ABSTRACT

A thermal treatment furnace is described in which gas leakage does not occur during thermal treatment at a high temperature. A thermal treatment furnace having a reaction tube is provided with an opening at one end and a flange surrounding the opening and covered by a cap abutting on the reaction tube at the flange to cover the opening. The flange is provided with a feature which introduces an inert gas to provide back pressure into the joint portion between the flange and the cap, thus preventing reaction gas from leaking to the outside of the furnace through the gap between the flange and the cap. The flange may be further modified to discharge gas under back pressure from between the joint surfaces of the flange and the cap to prevent the inert gas from affecting the reaction in the tube.

6 Claims, 4 Drawing Sheets

THERMAL TREATMENT FURNACE HAVING GAS LEAKAGE PREVENTING FUNCTION

FIELD OF THE INVENTION

The present invention relates generally to a thermal treatment furnace and, more particularly, to a thermal treatment furnace having a function of preventing a gas in the furnace from leaking to the outside. The term "thermal treatment" used in this specification widely means that an object is heated for treatment in a gas atmosphere, and includes the case where a chemical reaction such as oxidation or reduction takes place.

BACKGROUND OF THE INVENTION

FIG. 1 illustrates a cross-sectional view of a conventional thermal treatment furnace. A thermal treatment furnace 10 includes a reaction tube 1 and a cap 2. The cap 2 closes an opening 3 of the tube 1 to confine a gas in the tube 1. The tube 1 has a supply port 4 and an exhaust port 5 for a reaction gas. The reaction gas goes to the supply port 4 from a gas supply apparatus (not shown) through a pipe, and is supplied into the tube 1. The gas going out through the exhaust port 5 is treated by a gas treatment apparatus (not shown) and is exhausted. Within the tube 1 are mounted objects 6, for example, semiconductor substrates such as silicon wafers. The interior of the tube 1 is heated by a heater (not shown) provided inside or outside the tube 1.

FIG. 2 is an enlarged view of the portion of a conventional thermal treatment furnace indicated by symbol A in FIG. 1. In the case where the treatment temperature increases to a high temperature of about 800° C. or higher, an O-ring for sealing cannot be used at a joint portion between the tube 1 and the cap 2. This is because the heat resistance of the O-ring is low. Therefore, as shown in FIG. 2, a small gap 7 is undesirably produced at the joint portion between the tube 1 and the cap 2, and a problem arises in that the gas in tube 1 leaks through this gap (reference numeral 7 in FIG. 2). Especially when the leaking gas is a highly reactive (corrosive) gas, it has a greatly adverse influence on an external environment. Therefore, a thermal treatment furnace without gas leakage during high-temperature thermal treatment is demanded.

SUMMARY OF THE INVENTION

An object of the present invention is to provide a thermal treatment furnace without gas leakage even at the time of high-temperature thermal treatment.

A thermal treatment furnace in accordance with the present invention is characterized by having a reaction tube provided with an opening at one end thereof and a flange surrounding the opening, and a cap abutting on the reaction tube at the flange to close the opening, and including means for preventing a gas in the reaction tube from leaking to the outside through a gap formed at the joint portion between the flange and the cap and further including means for discharging a leaking gas in the gap between joint surfaces of the flange and the cap.

Also, the thermal treatment furnace in accordance with the present invention is characterized in that the flange of the reaction tube constituting the thermal treatment furnace has a groove and a hole for supplying an inert gas into the gap between the joint surfaces of the flange and the cap, and that the flange further has a groove and a hole for discharging the leaking gas passing through the gap between the joint surfaces of the flange and the cap.

The novel features believed to be characteristic of this invention are set forth in the appended claims. The invention itself, however, as well as other objects and advantages thereof, may be best understood by reference to the following detailed description of an illustrated preferred embodiment to be read in conjunction with the accompanying drawings.

DESCRIPTION OF THE PREFERRED EMBODIMENTS

Figure 2:
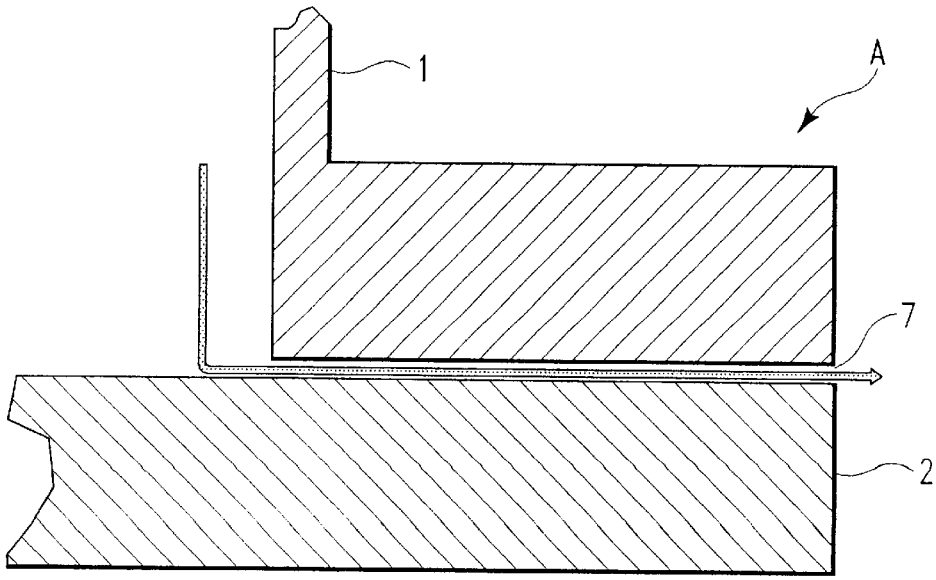
FIG. 2 (Prior Art)
FIG. 2 illustrates an enlarged view of the portion of a conventional thermal treatment furnace indicated by symbol A in FIG. 1.
Figure 3:
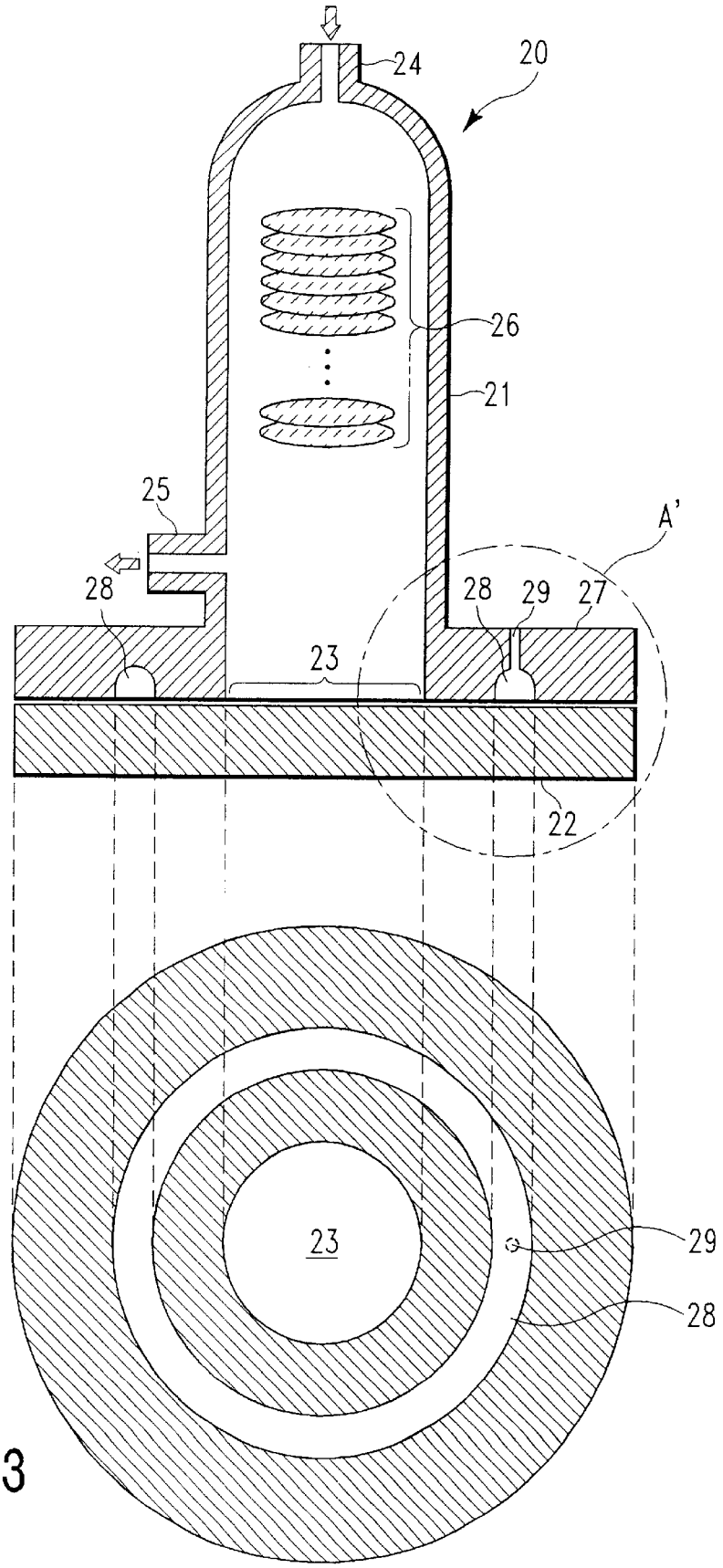
FIG. 3 illustrates both a vertical and an areal cross-sectional view of a first embodiment of a thermal treatment furnace in accordance with the present invention.

Embodiments of the present invention will be described with reference to the accompanying drawings. FIG. 3 illustrates a vertical cross-sectional view showing a first embodiment of a thermal treatment furnace in accordance with the present invention. A thermal treatment furnace 20 includes a reaction tube 21 and a cap 22. The cap 22 closes an opening 23 of the tube 21 to confine a gas in the tube 21. The tube 21 has a supply port 24 and an exhaust port 25 for a reaction gas. The reaction gas goes to the supply port 24 from a gas supply apparatus (not shown) through a pipe, and is supplied into the tube 21. The gas going out through the exhaust port 25 is treated by a gas treatment apparatus (not shown) and is exhausted. Within the tube 21 are mounted objects 26, for example, the objects may be semiconductor substrates such as silicon wafers. The interior of the tube 21 is heated by a heater (not shown) provided inside or outside the tube 21. The above-described configuration of the furnace shown in FIG. 3 is the same as the configuration of the conventional example shown in FIG. 2.

Figure 4:
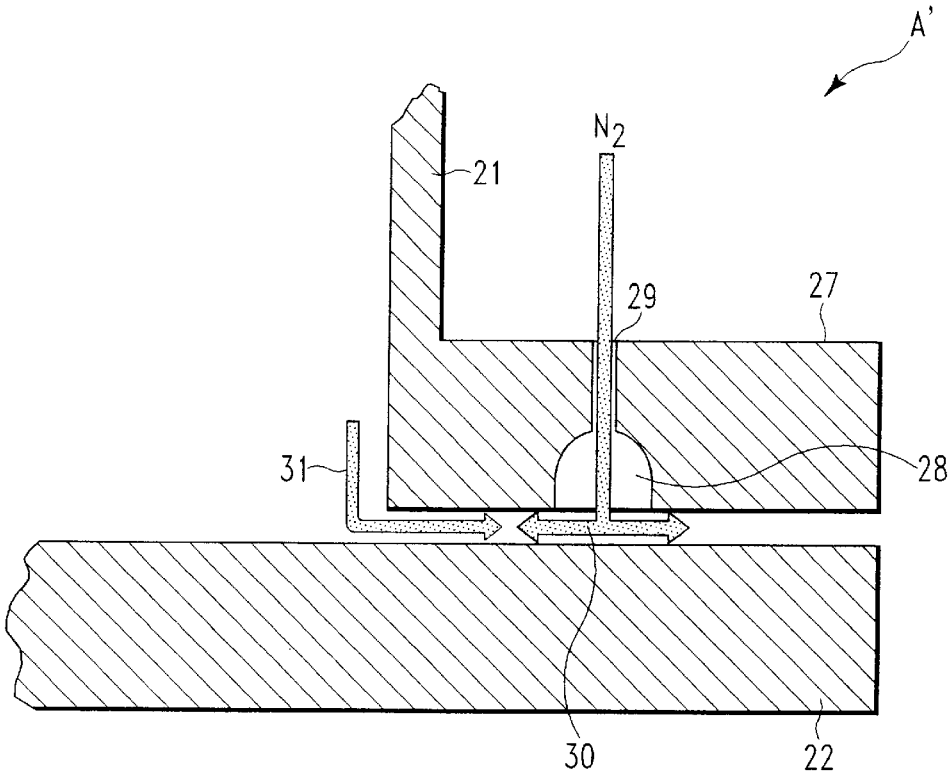
FIG. 4 illustrates an enlarged view of the portion of the first embodiment of a thermal treatment furnace indicated by symbol A' in FIG. 3.

Referring to FIG. 3, in accordance with the present invention, a groove 28 and a hole 29 are formed in the flange 27 of the tube 21. The groove 28 is formed concentrically with the flange 27. FIG. 4 is an enlarged view of the portion indicated by symbol A' in FIG. 3. As shown in FIG. 4, the groove 28 is connected to the hole 29 at an arbitrary location on the concentric circle, and the hole 29 penetrates the flange 27. The number of the holes 29 is not limited to one, and a plurality of holes 29 may be provided.

Figure 1:
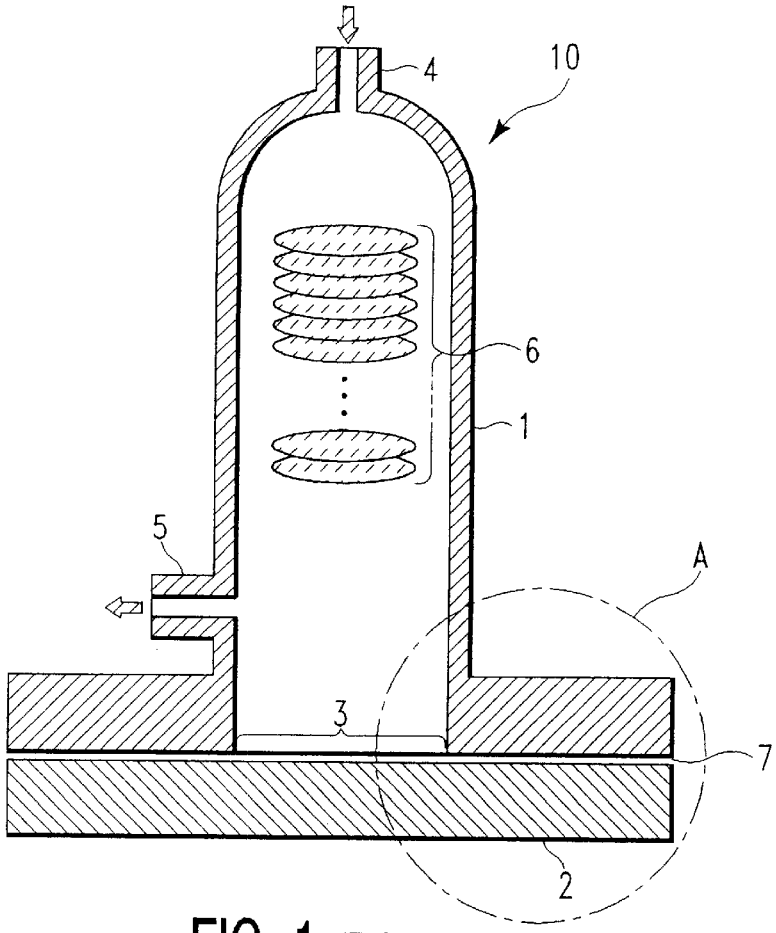
FIG. 1 (Prior Art)
FIG. 1 illustrates a vertical cross-sectional view showing a conventional thermal treatment furnace.

In a thermal oxidation treatment process for silicon wafers, a gas such as oxygen gas or hydrogen chloride gas is introduced into the reaction tube (1 in FIG. 1 or 21 in FIG. 3) as a reaction gas. The hydrogen chloride gas is used as a halogen additive. The interior of the tube (1 in FIG. 1 or 21 in FIG. 3) is heated to a temperature not lower than about 800° C., for example, about 800° C. to 1200° C. by the heater. In this case, for the conventional thermal treatment furnace, as described above, the oxygen gas or the hydrogen chloride gas in the tube 1 leaks undesirably to the outside through the small gap 7 between the joint surfaces of the tube and the cap (see FIGS. 1 and 2).

By contrast, for the thermal treatment furnace 20 in accordance with the present invention, an inert gas, for example, nitrogen gas, is injected through the hole 29 connecting to the groove 28. The inert gas may be another inert gas such as helium gas or argon gas. By the flow 30 of this injected inert gas, the gas 31 in the tube 21 that tends to leak through the gap is pushed back as shown in FIG. 4, thereby preventing gas leakage. The flow rate of the injected inert gas has only to be sufficiently lower than the flow rate of the reaction gas introduced into the tube 21 (for example, by a factor of about one tenth). The amount of the inert gas can be ignored with respect to the amount of the reaction gas, so that even if the inert gas 30 is caused to flow into the tube 21, the thermal oxidation reaction in the tube 21 is not affected. The flow rate of the injected inert gas 30 can be determined appropriately according to the size of the thermal treatment furnace, the amount of leaking gas, and the like.

Figure 5:
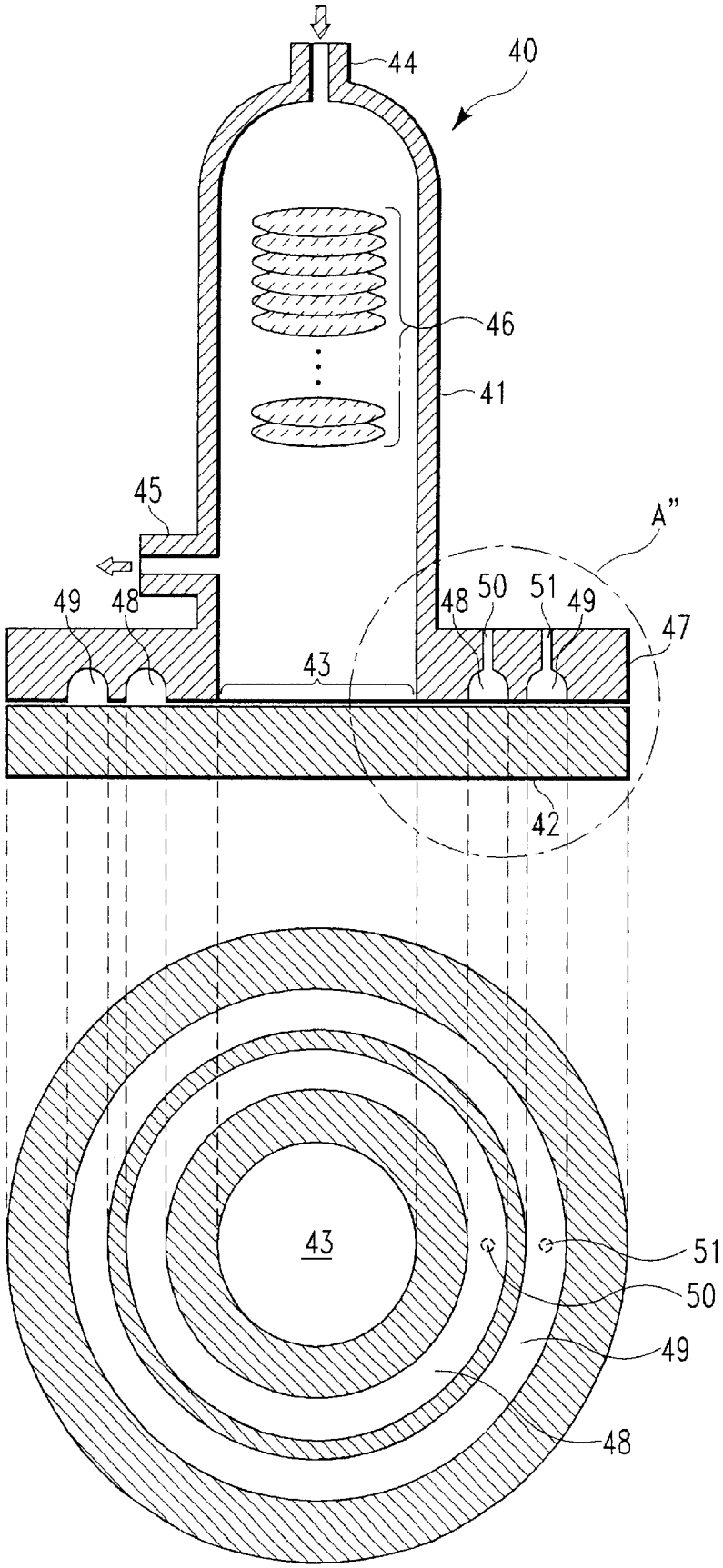
FIG. 5 illustrates both a vertical and an areal cross-sectional view view of a second embodiment of a thermal treatment furnace in accordance wit h the present invention.

FIG. 5 illustrates another embodiment of a thermal treatment furnace in accordance with the present invention. A thermal treatment furnace 40 includes a reaction tube 41 and a cap 42. The cap 42 closes an opening 43 of the tube 41 to confine a gas in the tube 41. The tube 41 has a supply port 44 and an exhaust port 45 for a reaction gas. The reaction gas goes to the supply port 44 from a gas supply apparatus (not shown) through a pipe, and is supplied into the tube 41. The gas going out through the exhaust port 45 is treated by a gas treatment apparatus (not shown) and is exhausted. Within the tube 41 are mounted objects 46, for example, semiconductor substrates such as silicon wafers. The interior of the tube 41 is heated by a heater (not shown) provided inside or outside the tube 41. The above-described configuration of the furnace shown in FIG. 5 is the same as the configuration of the conventional example shown in FIG. 2 and of the embodiment shown in FIG. 3.

Figure 6:
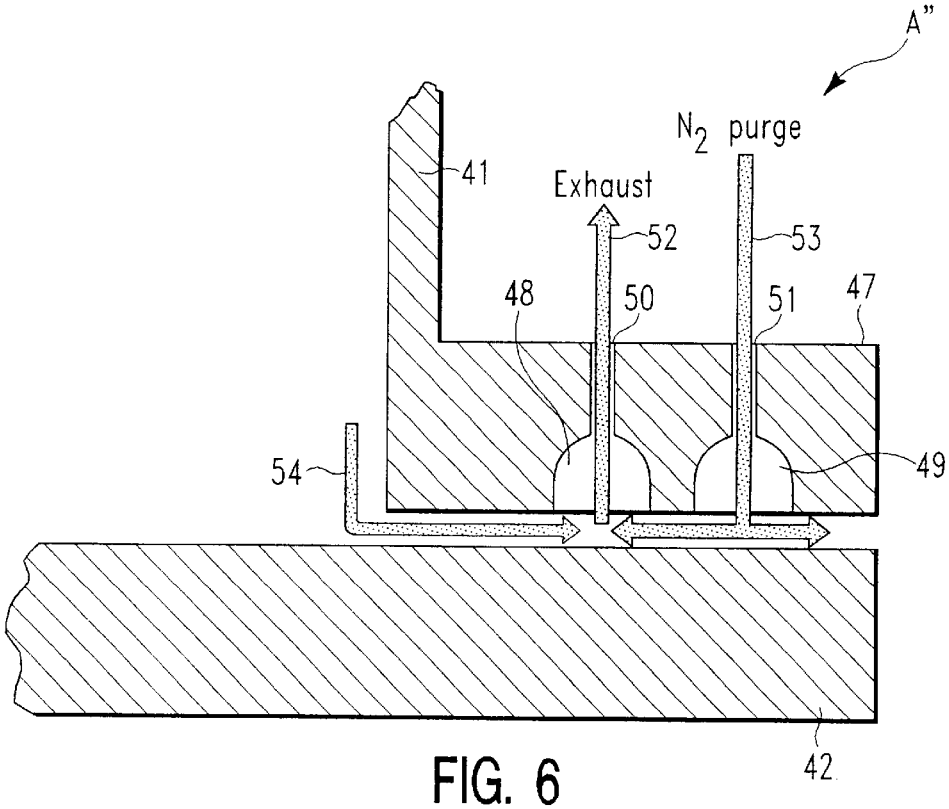
FIG. 6 illustrates an enlarged view of the portion of the second embodiment of a thermal treatment furnace in accordance with the present invention indicated by symbol A" in FIG. 5.

Referring to FIG. 5, in accordance with the present invention, two grooves (48, 49) are formed in the flange 47 of the tube 41. The two grooves 48 and 49 are formed concentrically with the flange 47. FIG. 6 is an enlarged view of the portion of the furnace indicated by symbol A" in FIG. 5. As shown in FIG. 6, the grooves 48 and 49 are connected to holes 50 and 51, respectively, at an arbitrary location on the concentric circle, and the holes 50 and 51 penetrate the flange 47. The number of the holes 50 and 51 each is not limited to one, and a plurality of respective holes 50 and 51 may be provided.

Of the two holes (grooves), the hole 51 (groove 49) is used as an injection port for an inert gas as in the embodiment shown in FIG. 3. In the present embodiment, the hole 50 (groove 48) is used as an exhaust port for a leaking gas 54 leaking from the tube 41 and the injected inert gas 53. The thermal treatment furnace 40 (see FIG. 5 and FIG. 6) has the functions of pushing back the leaking gas 54 leaking from the tube 41 into the tube 41 by the flow of the inert gas 53 supplied through the hole 51 (groove 49) for supplying gas, and of discharging some leaking gas through the hole 50 (groove 48) for discharging gas 52. Therefore, the leakage of gas to an external environment from the tube 41 can be prevented completely. Also, some of the injected inert gas 53 is also exhausted through the hole 50 (groove 48) for discharging gas 52. Thereupon, the amount of inert gas 53 entering the tube 41 is decreased, so that there is less fear of affecting the thermal oxidation reaction in the tube 41.

The above are various descriptions of the embodiments of the present invention given with reference to the drawings. The present invention is not limited to the above-described embodiments. In addition to the above-described embodiments, the present invention can be applied by making various improvements, changes, and modifications based on the knowledge of a person skilled in the art without departing from the spirit and scope of the invention.

I claim:

1. A thermal treatment furnace comprising:

a reaction tube provided with an opening at one end thereof and a flange extending outwardly from said opening, said flange having a flange surface proximate to and surrounding said opening;

a cap abutting on said reaction tube at said flange, said cap having a cap surface in substantial contact with said flange surface at joint surfaces so that said cap covers said opening; and a gas flow feature coupled to said joint surfaces, wherein said gas flow feature comprises:

a first groove formed in said flange surface, said first groove surrounding said opening; and a first hole provided in said flange, said first hole preheating said flange at least at one location of said first groove, said first hole for providing back pressure into said first groove and said joint surfaces.

2. The thermal treatment furnace according to claim 1 further comprising a source of inert gas, said source of inert gas connected to said first hole.

3. The thermal treatment furnace according to claim 1, wherein said gas flow feature further comprises:

a second groove formed in said flange surface, said second groove positioned between said first groove and said opening; and a second hole provided in said flange, said second hole penetrating said flange at least at one location of said second groove, said second hole for discharging gas from said second groove and said joint surfaces.

4. The thermal treatment furnace according to claim 3, wherein said opening has a circular shape, and said second groove is formed concentrically with said opening.

5. The thermal treatment furnace according to claim 1, wherein said opening has a circular shape, and said first groove is formed concentrically with said opening.

6. The thermal treatment furnace according to claim 5, wherein said gas flow feature further comprises:

a second groove formed in said flange surface, said second groove positioned between said first groove and said opening and wherein said second groove is formed concentrically with said opening; and a second hole provided in said flange, said second hole penetrating said flange at least at one location of said second groove, said second hole for discharging gas from said second groove and said joint surfaces.

* * * * *